United States Patent [19]

Won

[11] Patent Number: 4,790,482

[45] Date of Patent: Dec. 13, 1988

[54] SHEET METAL LIQUID ATOMIZER

[76] Inventor: Vann Y. Won, 6697 Gloria Dr., Sacramento, Calif. 95831

[21] Appl. No.: 24,448

[22] Filed: Mar. 11, 1987

[51] Int. Cl.[4] ..... B05B 3/02

[52] U.S. Cl. ..... 239/215; 261/91; 415/206; 416/DIG. 3

[58] Field of Search ..... 239/214, 215, 216; 415/206, 213 R, 213 A, 213 B, 213 C; 416/DIG. 3; 261/91

[56] References Cited

U.S. PATENT DOCUMENTS

| | | | |
|---|---|---|---|
| 2,537,833 | 1/1951 | Joos | 261/91 |
| 2,783,088 | 2/1957 | Butler | 239/215 |
| 3,253,821 | 5/1966 | Jamison | 239/215 |
| 3,659,957 | 5/1972 | Yuen | 416/179 |
| 3,791,797 | 2/1974 | Yuen | 23/312 R |
| 3,801,016 | 4/1974 | Martin | 239/219 |
| 4,432,775 | 2/1984 | Won | 55/41 |
| 4,465,559 | 8/1984 | Won | 203/90 |
| 4,511,084 | 4/1985 | Won | 239/223 |
| 4,522,766 | 6/1985 | Sunada | 261/91 |
| 4,551,153 | 11/1985 | Won | 48/102 R |
| 4,582,255 | 4/1986 | Won | 239/222.19 |
| 4,624,411 | 11/1986 | Won | 239/222.19 |

*Primary Examiner*—Andres Kashnikow
*Assistant Examiner*—Karen B. Merritt
*Attorney, Agent, or Firm*—Jacob N. Erlich; Donald J. Singer

[57] ABSTRACT

The invention relates to a liquid atomizer having a liquid atomizing rotor rotatable about an axis, and designed to feed a liquid into its inlet, along a liquid flow surface of the rotor and through its outlet as an atomized spray. The liquid flow surface is formed by a bent sheet member, fluted or zig-zag in formation, forming a closed figure surrounding the axis, and two generally symmetrically formed sheet portions, and doubler seams on diametrically opposite sides of the sheet portions for counterbalancing during rotor rotation about the axis.

10 Claims, 1 Drawing Sheet

SHEET METAL LIQUID ATOMIZER

STATEMENT OF GOVERNMENT INTEREST

The invention described herein may be manufactured and used by or for the Government for governmental purposes without the payment of any royalty thereon.

CROSS REFERENCE(S) TO RELATED APPLICATIONS

Closely related patent applications filed by applicant as inventor include: (1) U.S. Pat. No. 3,659,957 (hereinafter "Patent '957"), patented May 2, 1972, and entitled "Apparatus For Atomizing Liquid Materials", (2) U.S. Pat. No. 4,511,084 (hereinafter "Patent '084"), patented Apr. 16, 1985, and entitled "Top Feeding Liquid Atomizer", (3) U.S. Pat. No. 4,582,255 (hereinafter "Patent '255"), patented Apr. 15, 1986, and entitled "Self-Propelled, Floating, Rotary, Liquid Atomizer" (4) U.S. Pat. No. 4,624,411 (hereinafter "Patent '411"), patented Nov. 25, 1986, and entitled "Self Propelled, Rotary, Liquid Atomizer."

BACKGROUND OF THE INVENTION

1. Field of the Invention

The field of the invention is to liquid atomizers.

2. Description of the Related Prior Art

The prior art does not disclose a rugged and durable liquid atomizer having stamped sheet metal parts, especially of zig-zag or fluted formation.

SUMMARY OF THE INVENTION

The invention relates to a liquid atomizer having a liquid atomizing rotor rotatable about an axis, and designed to feed a liquid from its inlet, along a liquid flow surface of the rotor, and through its outlet as an atomized spray. The liquid flow surface is formed by a bent sheet member, fluted or zig-zag in formation, forming a closed figure surrounding the axis, and including two generally symetrically formed sheet portions, and doubler seams on diametrically opposite sides of the sheet portions for counterbalancing during rotor rotation about the axis.

One object of the invention is to provide a device for vaporizing, mixing, liquid fogging and/or misting, agitating, blending, dispersing, pumping, spraying, evaporating, distilling, separating, extracting, emulsifying and similar actions.

A further object of the present invention is to provide an atomizer having stamped components, simplicity of manufacture and economical, rugged and durable construction.

A further object of the present invention is to provide a liquid atomizer usable in distilling mercury, separating liquids, atomizing/distilling systems, fuel vaporizing, atomizing carburetors, mist generators, aircraft hydraulic fluid recycling process, etc.

A further object of the present invention is to provide an atomizer characterized by its inexpensive costs of manufacture and operation, ease of assembly and manufacture of its component parts, design for mass production, structural simplicity, many desirable operating and use features, multiplicity of functional advantages for some of its component structural parts, attractive exterior appearance, safe operating characteristics, and long wear life.

These and other objects, novel features and additional advantages of the present invention will become more clearly apparent to one skilled in the pertinent art by reference to the appended claims as the following detailed description of the preferred embodiment(s) of the invention and discussion proceeds in conjunction with the accompanying drawings, wherein like elements are given like reference numerals throughout. The drawings are not necessarily to scale; emphasis instead is being placed upon illustrating the principles of the invention.

DESCRIPTION OF THE PREFERRED EMBODIMENT(S)

Figure 1:
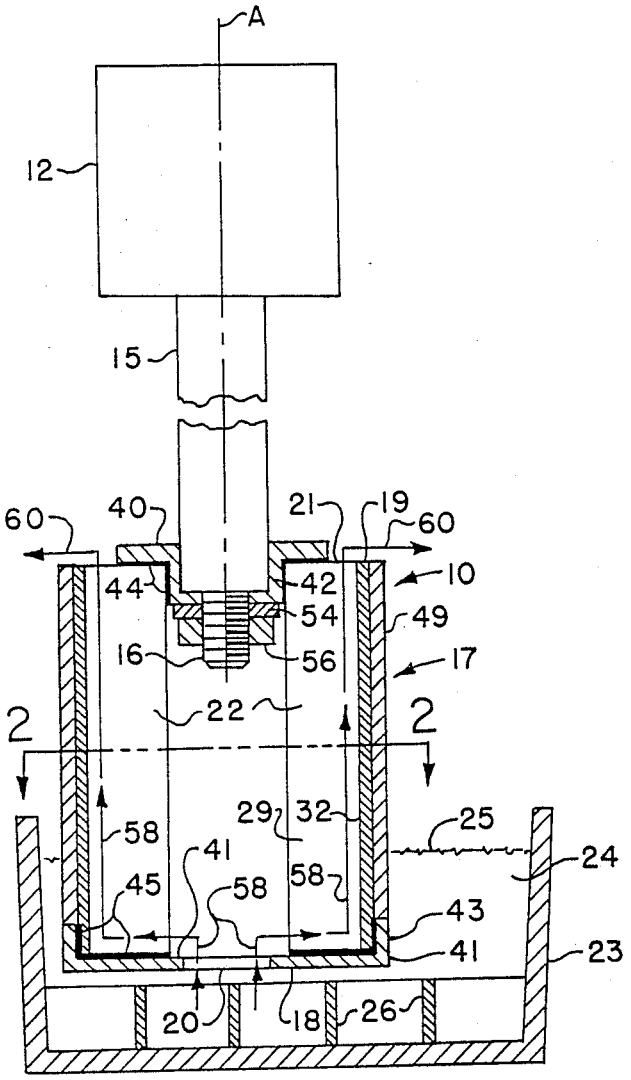
FIG. 1 is a side elevational view of the liquid atomizer of the present invention, taken partially in vertical, longitudinal, sectional view generally along lines 1—1 in FIG. 2.

Electric drive motor 12 has rotatable shaft 15 rotatably driving about axis A atomizing rotor 17 of liquid atomizer 10.

Rotor 17 has spaced apart ends, including bottom end 18, having liquid inlet 20 and top end 19 having fluid outlet 21, connected by rotor internal bore 22.

Liquid atomizer 10 is a so-called "bottom-feeding liquid atomizer" similar in mode of operation to "Patent '957", wherein rotor liquid inlet 20 in rotor bottom end 18 is immersed into liquid 24 below liquid level 25 in container 23 of liquid 24 to provide a supply of liquid to feed atomizer 10. Baffles 26 have been secured to the bottom of container 23 to cut down the possibility of adverse whirlpools being formed in liquid 24 during the atomizing action, while liquid 24 is being sucked up into rotor 17 through liquid inlet 20.

Figure 2:
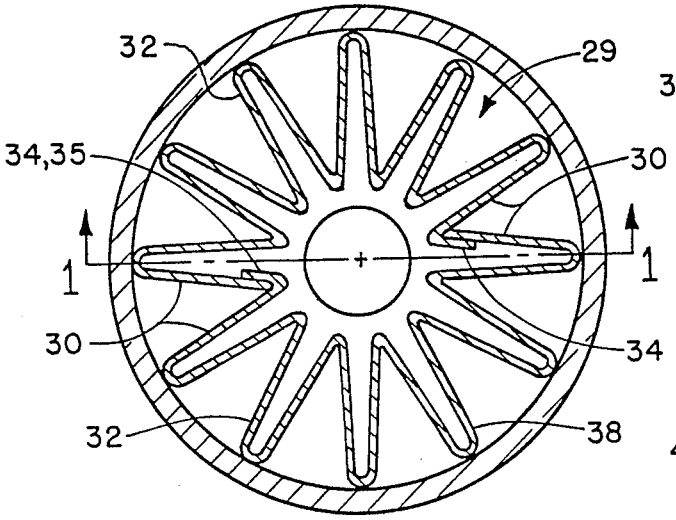
FIG. 2 is a horizontal, sectional view taken generally along lines 2—2 in FIG. 1.

Rotor 17 includes in FIG. 2 two, generally symmetrically formed, sheet metal portions 30, 30 formed, such as by stamping, into zig-zags or flutes 32, and has opposite sides 34 of portions 30 soldered, welded, or brazed into doubler seams 35 on diametrically opposite sides of sheet portions 30 and axis of rotation A for counterbalancing rotor 17 during rotor 17 rotation about axis A. Two sheet portions 30 thus form fluted sheet metal member or body 29 forming closed figure 38 surrounding axis A in FIG. 2. Flutes 32 form portions of through passageways in rotor bore 22 extending from inlet 20 to outlet 21.

Figure 3:
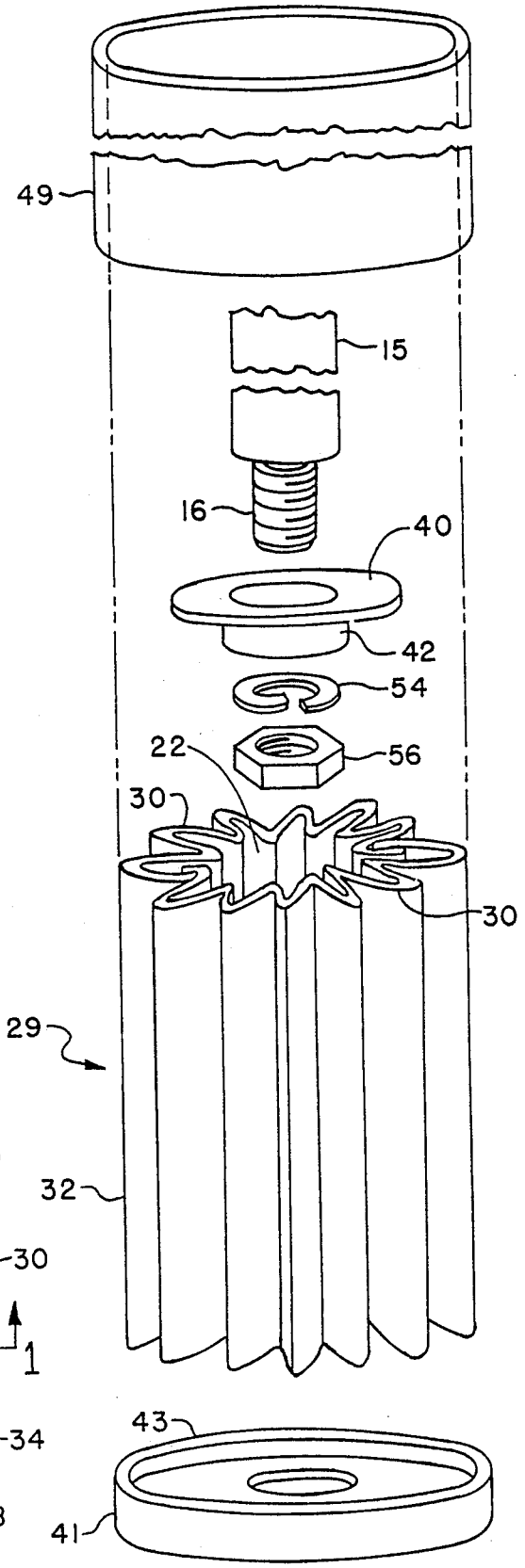
FIG. 3 is a longitudinally exploded view of the component parts of the liquid atomizer in FIG. 1.

Rotor 17 includes two annular members 40 and 41 in FIGS. 1 and 3 secured to bent sheet member 29, with member 40 being secured to top end 19 and member 14 being secured to bottom end 18, to rigidify and strengthen bent sheet member 29 and to help direct fluid flow during the atomizing action. Annular members 40 and 41 are sheet metal stampings respectively having sleeve portions 42 and 43 and secured to opposite ends of bent sheet members 30 by soldering, such as by silver soldering, welding, brazing, or spot welding 44 and 45 to form liquid inlet 20 as axial, central hole in bottom end 18 of rotor 17, and fluid outlet 21 as an annular opening formed around annular member 40, and between annular member 40 and the bore of sleeve 49.

One or more seamless tubes or sleeves 49, only one of which is shown in FIG. 1, are telescoped over the outside of fluted sheet member 29, and may either remain loose thereon, or be welded or otherwise secured thereto, to prevent turbulence in liquid 24 during atomizing which might otherwise be caused by the fluted periphery of rotor 17 if it were not covered by sleeve 49.

Fluted sheet member 29 may be made of any one of many different materials, depending upon its application. Recommended sheet metal material includes stainless steel, such as type 321, 347, etc; or other corrosion-resistive alloys. Galvanized steel, copper, or aluminum may also be used. Tantalum, platinum or other noble metal, and metal (such as gold) plating may be used in laboratory, drug or chemical manufacturing, and in high purity and high quality applications.

Fluted, sheet metal rotor 17 is secured to the lower end of electric motor drive shaft 15 by drive shaft threaded end 16 extending through the central hole in top annular member 40 and secured thereto by lock washer 54 and retaining nut 56 telescoped over and screwed onto threaded end 16.

Liquid atomizer 10 can be used to atomize liquid 24 traveling along liquid feed flow 58. Bottom end 18 of atomizing rotor 17 is lowered into liquid 24 to be atomized, and liquid 24 in liquid feed flow 58 enters atomizer rotor 17 through inlet 20 at bottom end 18. During rotation, such as at 3600 RPM (the higher the RPM, the better), liquid 24 will be forced centrifugally outwardly against and along fluted outer ridges 32, downwardly against annular member 41 forming the bottom plate, then rises upwardly and lifts to the top of rotor bore 22 and flutes 32. Then, the centrifugal force pressurized liquid is hurled outwardly, horizontally from the top of bore 22 to exhaust its energy of momentum into tiny mist droplets, which are sprayed in a 360 degree pattern about axis A with tremendous speed and force to provide an atomizing or vaporizing action to liquid 24. Axially extending flutes 32, forming the outer surface of bore 22, divide and separate liquid 24 into separate streams to enhance this atomizing action. Otherwise, if liquid 24 were not thus so divided by flutes 32, but instead remained in a single mass, this liquid would form a cone and whirl, instead of being so driven into the atomizing action. Its fluted design makes a more efficient atomizer.

Therefore, liquid atomizing rotor 17 includes liquid-feeding atomizing means, responsive to rotation of rotor 17 about axis A, for feeding liquid 24 by liquid feed flow 58 from inlet 20 and through outlet 21 as an atomized spray with flutes 32 forming in rotor bore 22 liquid flow surfaces providing a portion of this liquid flow path from inlet to outlet and being formed by bent, fluted sheet member 29.

Each of applicant's closely related patent applications—this patent application, Patent '957, Patent '084, Patent '255 and Patent '411—have the same mode of operation. In each, a rotating, liquid atomizing rotor feeds liquid from its inlet as fluid through its outlet as an atomized spray in response to rotation of the rotor upon its central longitudinal axis while liquid flows over a liquid flow surface in the rotor bore. Therefore, it will be appreciated by those of ordinary skill in the art that one may readily substitute for the rotor in any of these patents atomizing rotor 17, or its equivalent, such as fluted sheet member 29 in closed figure 38 formation, and having suitably formed annular members 40, 41, or any modifications thereof within ordinary skill in the art. Then, the liquid atomizer thus made from the disclosure in any of these patents would be a stamped, fluted or zig-zag, sheet metal rotor of rugged, durable and inexpensive construction similar to the construction shown in FIGS. 1–3 herein, having superior operating characteristics, but still operating by the same general mode of operation.

The invention may be embodied in other specific forms without departing from the spirit or essential characteristics thereof. It is understood that: the present embodiment(s) are therefore to be considered in all respects as illustrative and not restrictive, the words which have been used are words of description rather than words of limitation, the scope of the invention is indicated by the appended claim(s) rather than by the foregoing description, and all changes which come within the meaning and range of equivalency of the claim(s) are therefore intended to be embraced therein.

What is claimed is:

1. A liquid atomizer comprising:

a liquid atomizing rotor rotatable about an axis and having a rotor liquid inlet and a rotor fluid outlet, said liquid atomizing rotor including liquid feeding atomizing means responsive to rotation of said rotor about said axis for feeding the liquid from said inlet and through said outlet as an atomized spray, said means including liquid flow surfaces providing at least a portion of the liquid flow path for said liquid from said inlet to said outlet, at least some of said flow surfaces being formed by a bent, fluted sheet member forming a closed figure surrounding said axis, and said sheet member including two generally symmetrically formed sheet portions, and doubler seams on diametrically opposite sides of said sheet portions for securing together opposite sides of said sheet portions for counterbalancing said rotor during rotor rotation about said axis.

2. The liquid atomizer of claim 1, further comprising some of said flutes forming a portion of a through passageway from the inlet to the outlet, said sheet member being a sheet metal member.

3. The liquid atomizer of claim 1, further comprising the rotor having two axially spaced apart ends.

4. The liquid atomizer of claim 3, further comprising the rotor having a bore, said rotor having said inlet in one of said ends and said outlet in one of said ends.

5. The liquid atomizer of claim 3, further comprising said liquid atomizing rotor including an annular member secured to said bent sheet member at one of said ends.

6. The liquid atomizer of claim 5, further comprising said liquid atomizing rotor including two annular members secured to said bent sheet member, one being secured at one end and the other being secured at the other end to rigidify the bent sheet member and rotor.

7. The liquid atomizer of claim 6, further comprising the bottom end of said rotor having a central hole.

8. The liquid atomizer of claim 7, further comprising said rotor having said inlet in one of said ends and said outlet in the other of said ends.

9. The liquid atomizer of claim 8, further comprising said rotor including a sleeve telescoped over the periphery of said fluted sheet member, said outlet being an annular opening around the other of said annular members.

10. A liquid atomizer comprising:

a liquid atomizing rotor rotatable about an axis and having a rotor liquid inlet and a rotor fluid outlet, said liquid atomizing rotor including liquid feeding atomizing means responsive to rotation of said rotor about said axis for feeding the liquid from said inlet and through said outlet as an atomized spray, said means including a liquid flow surface providing at least a portion of the liquid flow path for said liquid from said inlet to said outlet, at least some of said flow surfaces being formed by a bent, fluted sheet member, said fluted sheet member forming a closed figure surrounding said axis, an annular member secured to said bent sheet member at one of its end, and said rotor including a sleeve telescoped over the periphery of said fluted sheet member and abutting, at one end thereof, said annular member.

* * * * *